US008631427B2

(12) United States Patent
Weinblatt

(10) Patent No.: US 8,631,427 B2
(45) Date of Patent: Jan. 14, 2014

(54) AUDIENCE DETECTION

(75) Inventor: Lee S. Weinblatt, Teaneck, NJ (US)

(73) Assignee: Winmore, Inc., Tenafly, NJ (US)

( * ) Notice: Subject to any disclaimer, the term of this patent is extended or adjusted under 35 U.S.C. 154(b) by 593 days.

(21) Appl. No.: 12/419,949

(22) Filed: Apr. 7, 2009

(65) Prior Publication Data

US 2009/0265729 A1 Oct. 22, 2009

Related U.S. Application Data

(60) Provisional application No. 61/123,272, filed on Apr. 7, 2008.

(51) Int. Cl.
*H04H 60/33* (2008.01)

(52) U.S. Cl.
USPC ..... 725/10; 725/9; 725/11

(58) Field of Classification Search
None
See application file for complete search history.

(56) References Cited

U.S. PATENT DOCUMENTS 3,056,135 A 9/1962 Currey et al.
4,644,509 A * 2/1987 Kiewit et al. ..... 367/87
4,652,915 A 3/1987 Heller, III
4,718,106 A 1/1988 Weinblatt
5,457,807 A 10/1995 Weinblatt
5,630,203 A 5/1997 Weinblatt
6,311,982 B1 * 11/2001 Lebensfeld et al. ..... 273/460
6,407,779 B1 * 6/2002 Herz ..... 348/734
7,155,159 B1 * 12/2006 Weinblatt et al. ..... 455/2.01
2006/0015910 A1 * 1/2006 Onomatsu et al. ..... 725/72
2007/0011040 A1 * 1/2007 Wright et al. ..... 705/10
2009/0259939 A1 * 10/2009 Lockett et al. ..... 715/716

* cited by examiner

*Primary Examiner* — Brian Pendleton
*Assistant Examiner* — Cai Chen
(74) *Attorney, Agent, or Firm* — Cozen O'Connor

(57) ABSTRACT

A technique is disclosed for identifying members of an audience tuned to a program broadcast by a programming signal source, comprising the steps of storing personal identification signals in a plurality of portable devices to be carried by members of the audience; periodically transmitting said identification signals from the portable devices; providing a stationary detector to detect the identification signals if they exceed a selectable response of said detector; and setting the selectable response of said detector to a level such that the identification signals are detected only if the respective portable devices are located relative to the detector in positions where persons can perceive performance of the broadcast program.

18 Claims, 1 Drawing Sheet

AUDIENCE DETECTION

RELATED APPLICATIONS

Figure 1:
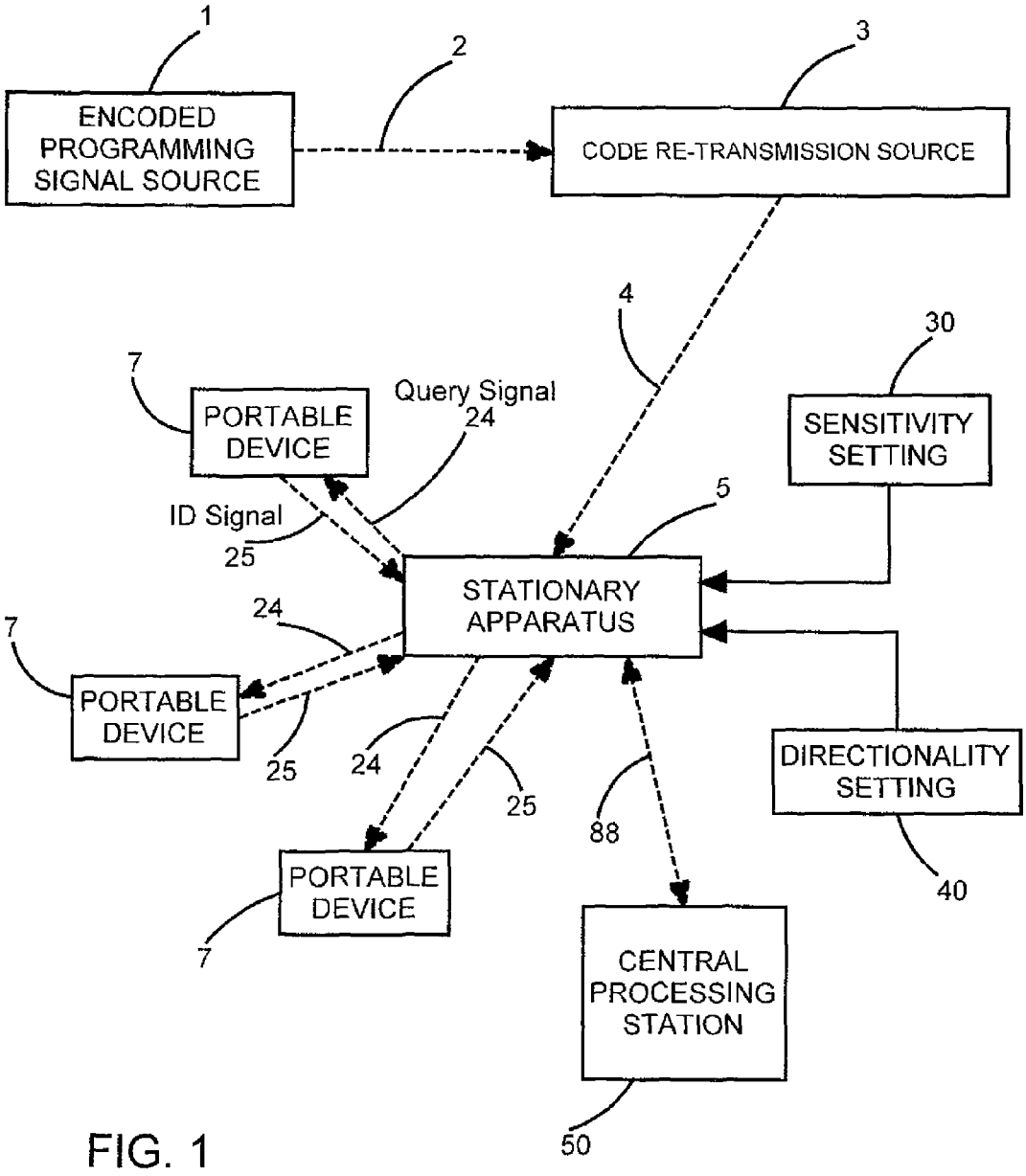

This application claims priority from U.S. Provisional Patent Application Ser. No. 61/123,272 which was filed on Apr. 7, 2008, the entirety of which is hereby incorporated herein by reference.

FIELD OF THE INVENTION

This invention is directed to a surveying technique to identify individual members of an audience while they are listening and/or watching a program performed from a programming signal source by reproduction equipment and, more particularly, to a technique that excludes persons from being considered part of the audience if they are outside a designated area.

BACKGROUND OF THE INVENTION

When a program is broadcast, it is important for a number of reasons to obtain information about the audience. The "program" can be audio and/or video, commercial and/or non-commercial, and is obtained as a programming signal from a program signal source. The "broadcast" of the program can be over the airwaves, cable, satellite, or any other signal transmission medium. This term also applies to playback from recording media such as audio tape, video tape, DAT, CD-ROM, and semiconductor memory. An "audience" for such program reproduction is constituted of the persons who perceive the program. Thus, all the people who have perceived any part of the program are included in the audience, but those present so as to perceive the program at a given time are considered as forming the audience in attendance.

The program is "performed" by any means which result in some form of perception by human beings, the most common being video and audio. The "reproduction equipment" is any and all types of units to convert a signal into human perceptible form.

The audience can be described as being "tuned" to a program when the signal source is a TV or radio broadcast station. This term may be less commonly applied when the signal source is a tape recorder. However, for the sake of brevity and convenience, the word "tuned" is applied herein to all situations in which an audience member selects a particular program, whether it be by twisting a dial, operating a remote control, or popping a cassette into a tape recorder for playback.

Audience survey information has been obtained in the past by audience measurement and market research organizations for advertisers and broadcasters. For example, advertisers are interested in knowing the number of people exposed to their commercials. Also, broadcasters use statistics on audience size and type for setting their advertising rates.

It is of interest to survey an audience not only in terms of its number but also to obtain characteristics of its individual members. Thus, for example, advertisers wish to identify the audience members by economic and social categories. This is possible if individual members of the audience can be identified.

Prior art techniques for obtaining such information involve primarily the following approaches. With one approach, people within the range of the radio station or who receive a television channel (either over the air or by cable) are contacted by phone and interviewed regarding their listening habits. Each person is questioned about the programs which that individual watched and/or listened to during the previous, say twenty-four hours. However, this technique is suspect because it is subject to recall errors as well as possible bias introduced by the interviewer. For example, if a specific TV program is mentioned to the person being interviewed, the suggestion may elicit a positive response to a question regarding whether that program was watched even when it actually was not. Another approach involves keeping diaries by persons agreeing to act as test subjects. Diary entries are to be made manually throughout the day to keep track of what signal sources are being watched and/or listened to. The diaries are collected periodically and analyzed. However, this approach is prone to inaccuracies because the test subjects may fail to make entries due to forgetfulness or laziness, or wrong entries can be made due to tardiness in attending to this task. Thus, it can be readily seen that the phone-contact, recall-dependent approach described above is unsatisfactory because people may not accurately remember what they listened to at any particular time and, also, because of the potential problem of suggestive bias. The diary-based approach is likewise unsatisfactory because people may not cooperate and be as meticulous in making timely diary entries as required to obtain the desired record-keeping accuracy. The above-described approaches require a significant and time-consuming effort on the part of the test participants to respond to the phoned-in questions or to record their TV viewing and/or radio listening habits.

Partly automated systems have also been developed which require relatively less active participation by the audience members. U.S. Pat. No. 3,056,135 issued to Currey et al. describes automatically determining the listening habits of wave signal receiver users. It provides a record of the number and types of persons using a wave signal receiver by monitoring the operational conditions of the receiver and utilizing both strategically placed switches for counting the number of persons entering, leaving and within a particular area and it employs a photographic recorder for periodically recording the composition of the audience. A mailable magazine provides a record of both the audience composition and the receiver operation information for manual processing by a survey organization. Shortcomings of this approach include the slowness with which data can be acquired and, further, many audience members object to being identified from the photographic record.

U.S. Pat. No. 4,644,509 issued to Kiewit et al. discloses an ultrasonic, pulse-echo method and apparatus for determining the number of persons in the audience and the composition of the audience of a radio receiver and/or a television receiver. First and second reflected ultrasonic wave maps of the monitored area are collected, first without people and second with people who may be present in the monitored area. The first collected background defining map is subtracted from the second collected map to obtain a resulting map. The resulting map is processed to identify clusters having a minimum intensity. A cluster size of the thus identified clusters is utilized to identify clusters corresponding to people in an audience. While this arrangement is effective for counting viewing audience members, individual audience members cannot be identified.

U.S. Pat. No. 4,652,915 issued to Heller, III describes a system for identifying the presence of TV viewers where the viewer wears a headphone which remains activated to receive audio by transmitting an acknowledgment signal in response to periodic polls.

Other automated audience surveying techniques are known in which the test participants forming the audience need only play a passive role. For example, it is known to utilize a survey signal transmitted by a broadcast station in combination with a programming signal. As disclosed in U.S. Pat. No. 4,718,106 issued to the present inventor, the transmitted survey signal is detected by a receiver and reproduced by a speaker. The speaker produces pressure waves in the air that can be detected by a microphone, for example, and with a frequency that is in what is scientifically regarded as the audible range of human hearing. Such pressure waves, or signals, are referred to as acoustic. An acoustic signal is regarded as being audible, irrespective of whether it is actually heard by a person, as long as it can be produced by a conventional speaker and detected by a conventional microphone. The audible acoustic signal is detected by a microphone and associated circuitry embodied in a portable device worn by the test participants, and data on the incidence of occurrence and/or the time of occurrence of the acoustic signal, and the code it contains, are stored and analyzed therein.

Variations of this passive technique can be found in U.S. Pat. Nos. 5,457,807 and 5,630,203 both issued to the present inventor.

With the passive technique of the prior art, each portable device could be pre-programmed with the unique identification ("ID") of its wearer. This ID information is downloaded to a central processing station with the detected codes stored in the portable device to provide not only audience measurement data but also information about the individual audience members.

Although such a portable-device-based approach has great potential, it has several shortcomings even when implemented with the latest integrated circuit technology. For example, the cost per unit is unacceptably high. Also, the devices are too heavy to be worn comfortably. Furthermore, such devices require a high capacity memory to store all the information needed to provide the desired survey information. Lastly, the battery life is inconveniently shortened by all the functions such a device would need to perform.

A further evolution in the use of a passive technique with a portable-device-based approach can be found in U.S. Pat. No. 7,155,159 co-invented and assigned to the present inventor. The subject matter disclosed in this patent is hereby incorporated by reference. A brief discussion of this patent is provided immediately below with regard to FIG. 1.

As shown in FIG. 1, an encoded signal is generated by a program signal source 1, such as a TV broadcast station. Its output signal 2, which is a combination of a programming signal and a surveying code, is received by code retransmission source 3. Code retransmission source 3 can be capable of suitably reproducing the programming signal for video and/or audio performance. However, for audience surveying purposes, its key function is to detect the surveying code in the signal 2 received from programming signal source 1, and then to retransmit it in suitable fashion as output signal 4, as explained below. The code re-transmitted by code retransmission source 3 is detected and processed by stationary apparatus 5. A plurality of portable devices 7 operate cooperatively with stationary apparatus 5, in a manner described below. Details of these key components will now be provided, as follows.

A discussion of the source 1 of encoded program signals can be found in the above-mentioned patents of the present inventor, and such discussion found therein is hereby incorporated herein by reference.

Details of code retransmission source 3 can also be found in the above-mentioned patents issued to the present inventor, and such details found therein are hereby incorporated herein by reference. Suffice it to say that code retransmission source 3 is preferably a conventional component of a commercially available video and/or audio instrument, such as a television set. The conventional component of interest could be, for example, the TV's speaker. No retrofitting of the instrument would be required in order for such component to function as a code retransmission source. In such case, the output of code retransmission source 3 to stationary apparatus 5 would be in the form of an acoustic signal. See U.S. Pat. No. 4,718,106. However, it is also contemplated that some relatively minimal circuitry could be added to process and retransmit the code, as discussed in the above-mentioned patents of the present inventor. See U.S. Pat. Nos. 5,457,807 and 5,630,203.

The reception location that stationary apparatus 5 would typically be placed within is an area containing an instrument for reproducing the video and/or audio programming signal ("location of interest"). The area would also be of sufficient size to accommodate an audience, preferably of several members. An example would be a room with a television set and seating capacity for several persons. Stationary apparatus 5 is a self-contained, relatively small and unobtrusive unit that can be placed on a surface in the room in such a way that communication between it and the portable devices worn by persons in the room is not blocked. To some extent, the restrictions on its placement depend on the nature of the communication signals, with radio signals providing a higher degree of flexibility than infrared signals, for example, The installation of stationary apparatus 5 is very simple in that it must be plugged into a wall outlet socket to receive power. Also, to enable data download, it is connected to a telephone line unless a cellular telephone device is used. Only a one time, fast, simple installation is involved that requires no retrofit of other apparatus in the house. This is in contrast to the prior art surveying equipment which does require a retrofitting operation. Apparatus 5 also improves the level of cooperation by the test participants because, for example, it overcomes any reluctance that prospective test participants would have to join the audience survey if it meant having holes drilled in their TV's, and the like.

Each of the persons cooperating as test participants is provided with a customized, portable device 7. All of the portable devices have identical circuitry. They are made unique, however, by virtue of the data stored therein. In particular, stored in each one is a unique ID signal which can be used to identify its wearer. Consequently, the devices cannot be interchanged among the various wearers but, rather, are specifically assigned to a particular person. Also, each portable device is provided with a unique delay period. The reason for this feature will become apparent from the description provided below.

The operations of stationary apparatus 5 and portable device 7 can be implemented, for example, by a suitable microprocessor receiving input signals and generating control signals responsive thereto. At preset transmission intervals, stationary apparatus 5 emits a query signal 24. A detector in portable device 7 is designed to detect query signal 24 and identify it as that particular signal. A determination is then made whether the detected signal is the query signal and, if so, the above-mentioned delay period will be initiated and performed by a delay circuit. When the end of the delay period is reached, portable device 7 will transmit the prestored ID signal 25. Thus, each of portable devices 7 within range of stationary apparatus 5 (i.e. worn by those persons within the reception location and thus forming the audience in attendance) will react to query signal 24 by transmitting its unique ID signal. However, since the delay period of each portable device 7 is unique, as mentioned above, this transmission of ID signals by the plurality of portable devices in the room will be staggered so that no ID signal "steps on" another.

The ID signals from the respective portable devices 7 are received by stationary apparatus 5 within a receive period. If such a signal has been detected, then stationary apparatus 5 performs a matching test to determine whether the detected signal matches any of the pre-stored ID's in its memory. If a match is found, then the detected ID signal is stored in memory.

If it is determined that no signal has been detected, or that a detected signal does not match any of the pre-stored ID's, then a determination is made whether the end of the receive period has been reached. If the end of the receive period has been reached, then this phase of the operation is ended, and this can be used to trigger data transfer, as described below.

Up to this point, a description has been provided which results in determining the specific identity of the audience members who are then in attendance within the reception location. Those identities are stored in memory. The frequency with which this determination is made is a matter of engineering choice depending on the memory capacity to be made available for this task versus the perceived importance of the need to have the most updated information regarding the audience. Thus, if the duration of the transmission interval for query signal 24 is selected to be one minute, for example, accurate data will be available promptly after any member of the audience leaves the room. However, this comes at the cost of requiring a higher memory capacity than would be needed, for example, if such duration were to be selected at 15 minutes.

The above-described surveying codes from broadcast signal 2 are re-transmitted by code retransmission source 3 and received by stationary apparatus 5. Each detected surveying code is stored in memory. Thus, for any given measurement period, as explained below, the memory has stored therein a combination of the ID's for all the audience members who are currently in attendance together with the surveying codes for the particular program being viewed by that audience during such time period. The output of a clock can also be used to time stamp the stored ID's and/or the stored surveying codes. This arrangement of storing the ID signals with the surveying codes received within the measurement period enables the association of a program segment being performed during it (as identifiable from the surveying code) with the audience then in attendance (as identifiable from the ID's). The provision of a time stamp can serve to gain additional information which may be of value.

Once information has been stored in memory, it is downloaded to central processing station 50. A download control trigger signal can be generated at preset intervals or at a preset time of day, as controlled by a clock, at any time by the manual operation of depressing a key, and/or by a remote trigger signal provided, for example, from the central processing station on communications link 88. Responsive to the control trigger signal, suitable download apparatus, such as a modem, will proceed to effect the transmission of data via communications link 88 from stationary apparatus 5 to the central processing station 50. The details of how this is implemented are well known and, thus, need not be described herein.

Use of stationary apparatus 5 provides a number of important improvements in audience surveying. Firstly, its installation into a household of test participants, for example, is fast and easy. Secondly, it is not reliant on battery power. Thirdly, the functions performed by apparatus 5 are such that the portable devices 7 can be relatively simple. Consequently, devices 7 can be light and small, and battery life is comparable to that of a digital watch, for example. Fourthly, it can be provided with any type of storage of any required capacity. For these and other reasons, the level of cooperation by the test participants is much higher than it would be with prior art approaches.

A significant variation is elimination of the query signal 24. Instead, portable devices 7 are designed to emit their ID signals at preset time intervals rather than being triggered to do so by the query signal.

Another possible variation is that the trigger signal is transmitted "periodically" at any regular and/or irregular intervals. It is mainly necessary to keep track of such trigger signal transmission so that the identification signals triggered in response thereto are identifiable. For the above-identified embodiment which does not utilize such a trigger signal, the identification signals can also be emitted "periodically" at regular and/or irregular intervals, the key point being that they are detected by the stationary apparatus.

Although the technique disclosed in U.S. Pat. No. 7,155,159 is effective to provide useful audience monitoring information, some further improvements may provide even more meaningful results. More specifically, since ID signal 25 is preferably an RF signal, it is possible that portable devices located in rooms other than the one in which the TV is located will have their ID signal picked up by stationary apparatus 5. If so, then perhaps a person will be counted as an audience member even though s/he is in another room, perhaps even on the other side of a wall.

Another source of possible inaccuracies is a person standing behind the TV which is displaying the program of interest. Stationary apparatus 5 will pick up the ID signal 25 from that person's portable device 7 even though the person cannot see the TV screen and, therefore, is not a real audience member, at least for visual perception.

Another possibility is that the person is in the same room as the TV, and also is in front of the TV. However, if the room is usually very noisy and if the person is at a certain distance away from, or at a certain angle to the side of the TV, the number of people in the way and/or the noise level in the room severely interfere with that person's ability to visually and/or audibly perceive the program. One such environment where this can happen is a bar.

SUMMARY OF THE INVENTION

One object of the present invention is to more accurately identify individual members of an audience.

A more specific object of the present invention is to exclude persons from being counted as members of an audience if they are positioned in an area where they cannot perceive the program of interest.

These and other objects are attained in accordance with one aspect of the present invention directed to a method for identifying members of an audience tuned to a program broadcast by a programming signal source, comprising the steps of storing personal identification signals in a plurality of portable devices to be carried by members of the audience; periodically transmitting said identification signals from the portable devices; providing a stationary detector to detect the identification signals if they exceed a selectable response of said detector; and setting the selectable response of said detector to a level such that the identification signals are detected only if the respective portable devices are located relative to the detector in positions where persons can perceive performance of the broadcast program.

Another aspect of the present invention directed to an apparatus for identifying members of an audience tuned to a program broadcast by a programming signal source, comprising: a plurality of portable devices to be carried by members of the audience, said portable devices having personal identification signals stored therein, and means for periodically transmitting said identification signals from the portable devices; a stationary detector to detect the identification signals if they exceed a selectable response of said detector; and means for setting the selectable response of said detector to a level such that the identification signals are detected only if the respective portable devices are located relative to the detector in positions where persons can perceive performance of the broadcast program.

Another aspect of the present invention directed to an apparatus for identifying members of an audience tuned to a program broadcast by a programming signal source, comprising a plurality of portable devices to be carried by members of the audience, said portable devices having personal identification signals stored therein, and a transmitter for periodically transmitting said identification signals from the portable devices; a stationary detector to detect the identification signals if they exceed a selectable response of said detector; and an arrangement setting the selectable response of said detector to a level such that the identification signals are detected only if the respective portable devices are located relative to the detector in positions where persons can perceive performance of the broadcast program.

BRIEF DESCRIPTION OF THE ONLY DRAWING

FIG. 1 is a schematic block diagram of the invention.

DETAILED DESCRIPTION OF THE DRAWING

To conduct the survey, persons are selected by the surveying organization based on certain criteria. These criteria can be, for example, age, income, geographic location, sex, and level of education. The broadcasting organization and/or advertisers may require an analysis of their listeners which is broken down into one or more of these categories. The individuals who are approached to be test subjects are merely asked to participate in a test the details of which are not explained. Each person is told only that a requirement of the test is the wearing of a certain article of clothing. Additional information is preferably not supplied in order to avoid predisposing or prejudicing the individual test subject toward or away from the aims of the survey. For example, if the individuals were told that the survey relates to a radio survey, then this might result in more time and attention being paid to radio listening than would be normal for that person. Even worse would be the situation were the individual informed of the particular radio station involved in the survey. In order to avoid this problem, each individual is given a portable device to wear on a regular basis as an article of clothing. For example, such a portable device might be a watch for men or a bracelet for women.

The present invention provides an approach for excluding a person from being counted as an audience member if that person is too far from the TV, is on the other side of a wall, or in any other area where the person's location is such as to make it unlikely or even impossible to perceive the program of interest. To this end, an embodiment of the present invention provides a signal sensitivity setting circuit 30. Stationary apparatus 5 includes a detector for picking up ID signal 25. The latter is emitted from portable device 7 with a preset signal strength. The detector of stationary apparatus 5 includes an antenna the output of which is coupled to suitable processing circuitry. The specific design features of such an antenna and processing circuitry are conventional and thus well known. Consequently, details thereof are not deemed necessary.

The stationary apparatus 5 has a selectable response to the ID signals 25. The response can be based, for example, on the directionality and sensitivity of the antenna. The response can also be based, for example, on the sensitivity (e.g. threshold) of the processing circuitry. Assuming that the antenna has a preset sensitivity (e.g. gain) and that the processing circuitry also has a preset sensitivity, all the ID signals 25 as outputted by the antenna to the processing circuitry which exceed the threshold will be passed through to the remaining above-described components of stationary apparatus 5 to be recorded as information pertaining to an audience member. However, this is not a desirable result if the ID signal is emitted by a portable device worn by a person who is, for example, on the other side of a wall. This undesirable result can be avoided by modifying the threshold, and thus the sensitivity, of the processing circuitry in stationary apparatus 5. This can be done in a variety of ways by sensitivity setting circuitry 30, as explained below.

One approach is to provide a factory setting that is specifically designed so that the ID signals are detected only when the person wearing the associated portable device 7 is, for example, within the same room as the TV displaying the program of interest. The value for such a threshold can be selected based on previously-gathered information or other criteria. For example, the previously-gathered information can be test data conducted on-site. The other criteria can involve the characteristics of the walls in terms of thickness and material of which they are constructed that can be used to calculate the transmission of RF signals therethrough. The other criteria can also apply to the above-mentioned "noisy bar" situation. Based, for example, on test data comparing the ability of a person at a certain location in the bar to perceive the program in relation to the threshold at which that person's ID signal is detected, a suitable threshold can be selected.

Another approach is to provide a plurality of factory settings for the threshold value. The selection of a specific threshold value can be set manually at the specific location of interest. For example, one of the available settings can be selected and then the readings of stationary apparatus 5 are checked as a portable device 7 is removed from the location of interest. If ID signal 25 is still being registered by stationary apparatus 5 even when the portable device 7 is outside of the location of interest, then a higher threshold (i.e. lower sensitivity) is selected.

A further approach is to perform the threshold selection automatically. For example, the portable device 7 can be positioned outside of the location of interest, and stationary apparatus 5 can be actuated into a sensitivity setting mode so that it sequentially selects higher thresholds until the ID signal 25 from that portable device 7 is no longer picked up.

A variation of this technique involves the use of any method and apparatus capable of detecting the number of persons within the location of interest. This can be done, for example, by ultrasonic means (as in the above-mentioned U.S. Pat. No. 4,644,509) or by heat-sensing means (e.g. using infrared sensors). The specifics are well known and, thus, need not be provided herein. Such apparatus can be considered to be part of sensitivity setting circuitry 30. Then, the number of detected persons is compared with the number of portable devices 7 from which an ID signal 25 is being detected. If the number of portable devices 7 exceeds the number of persons detected in the location of interest, then the portable device 7 with the weakest signal will be disregarded. On the other hand, if the number of persons detected in the location of interest exceeds the number of portable devices 7 from which an ID signal 25 is being detected, it is possible that one of such persons has not activated the portable device. An alert will then be actuated, perhaps in the form of a message on the TV screen, asking that each person's portable device 7 be turned on.

As pointed out above, another possible shortcoming of the technique disclosed in U.S. Pat. No. 7,155,159 is that a person will be behind the TV which is displaying the program of interest. In order to exclude such a person from being counted as a member of the audience, it is necessary to prevent the ID signal emitted from that person's portable device 7 from being registered by stationary apparatus 5. That can be done by suitably designing the antenna of stationary apparatus 5 in such a way so as to eliminate, or at least sharply reduce, the response of the antenna signals originating from behind the TV. Such designs are schematically represented in FIG. 1 by directionality setting device 40. Assuming that the antenna is positioned with its directionality toward the location of interest, nevertheless, the backlobes of the antenna will pick up signals originating from behind the TV. Techniques are well known to minimize these backlobes, such as by applying an appropriate phase difference to the antenna elements. Also, various screening, or shielding, techniques are available. One or more of these techniques can be utilized in order to overcome this possible shortcoming.

A further possible shortcoming mentioned above is that the beam width of the antenna is so wide that it may pick up the ID signals from portable devices 7 that are too much to the side of the TV screen displaying the program of interest. This can involve people in the same room as well as people in adjoining rooms. This possible shortcoming can be overcome by suitably controlling the beam width of the antenna. For example, it is well known that a narrower beam can be derived by using more elements in the antenna array. Conversely, the beam can be widened by using a fewer number of antenna elements. Thus, the width of the antenna beam can be factory preset by the number of elements installed in it. However, it is also possible to control the beam width by various known techniques. For example, a relatively large number of elements can be designed into the antenna. The antenna can then be installed in the desired location and the response can be monitored to determine whether the stationary apparatus 5 registers only those persons located within the area where they are likely to perceive the program. This is done with the antenna set to have a certain number of the built-in elements to be active. If it is determined that the beam width is too wide, then more of the elements are activated to make it narrower. Conversely, if it is determined that the width of the beam is too narrow, then one or more of the antenna elements is deactivated to widen the beam.

Although specific embodiments of the invention have been disclosed in detail above, various modifications thereto will readily occur to anyone with ordinary skill in the art. All such modifications are intended to fall within the scope of the present invention as defined by the following claims.

I claim:

1. A method for identifying members of an audience tuned to a program broadcast by a programming signal source, comprising the steps of:

storing personal identification signals in a plurality of portable devices to be carried by members of the audience;

periodically transmitting said identification signals from the portable devices;

providing a stationary detector to detect the identification signals;

automatically setting a threshold of processing circuitry in the stationary detector to detect the identification signals only if they exceed said threshold, wherein the threshold is set by positioning a portable device outside of the positions where persons can perceive performance of the broadcast and actuating the stationary detector into a sensitivity mode such that the stationary detector sequentially selects, without manual intervention, higher thresholds until an identification signal from the portable device is no longer picked up; and setting directionality of an antenna in the stationary detector such that the identification signals are detected only if the respective portable devices are located relative to the stationary detector in positions where persons can perceive performance of the broadcast program.

2. The method of claim 1, further comprising setting a sensitivity level of the stationary detector to detect the identification signals only if enabled by said sensitivity level.

3. The method of claim 1, wherein the method comprises determining the number of persons within a location of interest at which the broadcast program is being performed, comparing that number to the number of identification signals being detected by the detector, and if the number of identification signals being detected exceeds the determined number of persons within the location of interest, adjusting the response of the detector so as to eliminate the identification signal having the weakest signal.

4. The method of claim 1, wherein the method comprises determining the number of persons within a location of interest at which the broadcast program is being performed, comparing that number to the number of identification signals being detected by the detector, and if the determined number of persons within the location of interest exceeds the number of identification signals being detected, generating an alert to activate the portable devices.

5. The method of claim 1, wherein the broadcast program is transmitted by a programming signal source in combination with a surveying code, the method further comprising:

detecting said surveying code and associating said surveying code with said identification signals detected by the detector.

6. An apparatus for identifying members of an audience tuned to a program broadcast by a programming signal source, comprising:

a plurality of portable devices to be carried by members of the audience, said portable devices having personal identification signals stored therein, and transmitting units for periodically transmitting said identification signals from the portable devices;

a stationary detector to detect the identification signals, the stationary detector comprising processing circuitry configured to have a threshold set so that the identification signals are detected only if they exceed said threshold; and a setting unit for setting directionality of an antenna in the stationary detector such that the identification signals are detected only if the respective portable devices are located relative to the stationary detector in positions where persons can perceive performance of the broadcast program, wherein the threshold is set automatically in response to a portable device being positioned outside of the positions where persons can perceive performance of the broadcast, the stationary detector being configured such that the stationary detector sequentially selects, without manual intervention, higher thresholds until an identification signal from the portable device is no longer picked up.

7. The apparatus of claim 6, said stationary detector is configured to have a sensitivity level set so that the stationary detector detects the identification signals only if enabled by said sensitivity level.

8. The apparatus of claim 6, comprising a determining unit for determining the number of persons within a location of interest at which the broadcast program is being performed, comparing that number to the number of identification signals being detected by the detector, and if the number of identification signals being detected exceeds the determined number of persons within the location of interest, adjusting the response of the detector so as to eliminate the identification signal having the weakest signal.

9. The apparatus of claim 6, comprising a determining unit for determining the number of persons within a location of interest at which the broadcast program is being performed, comparing that number to the number of identification signals being detected by the detector, and if the determined number of persons within the location of interest exceeds the number of identification signals being detected, generating an alert to activate the portable devices.

10. The apparatus of claim 6, wherein the broadcast program is transmitted by a programming signal source in combination with a surveying code, the apparatus further comprising:

a detecting unit for detecting said surveying code and associating said surveying code with said identification signals detected by the detector.

11. A method for identifying members of an audience tuned to a program broadcast by a programming signal source, comprising the steps of:

storing personal identification signals in a plurality of portable devices to be carried by members of the audience;

periodically transmitting said identification signals from the portable devices;

providing a stationary detector to detect the identification signals if they exceed a selectable response of said stationary detector; and setting the selectable response of said stationary detector to a level such that the identification signals are detected only if the respective portable devices are located relative to the stationary detector in positions where persons can perceive performance of the broadcast program, wherein the method comprises determining the number of persons within a location of interest at which the broadcast program is being performed, comparing that number to the number of identification signals being detected by the stationary detector, and if the number of identification signals being detected exceeds the determined number of persons within the location of interest, adjusting the response of the stationary detector so as to eliminate the identification signal having the weakest signal.

12. A method for identifying members of an audience tuned to a program broadcast by a programming signal source, comprising the steps of:

storing personal identification signals in a plurality of portable devices to be carried by members of the audience;

periodically transmitting said identification signals from the portable devices;

providing a stationary detector to detect the identification signals if they exceed a selectable response of said stationary detector; and setting the selectable response of said stationary detector to a level such that the identification signals are detected only if the respective portable devices are located relative to the stationary detector in positions where persons can perceive performance of the broadcast program, wherein the method comprises determining the number of persons within a location of interest at which the broadcast program is being performed, comparing that number to the number of identification signals being detected by the stationary detector, and if the determined number of persons within the location of interest exceeds the number of identification signals being detected, generating an alert to activate the portable devices.

13. An apparatus for identifying members of an audience tuned to a program broadcast by a programming signal source, comprising:

a plurality of portable devices to be carried by members of the audience, said portable devices having personal identification signals stored therein, and transmitting units for periodically transmitting said identification signals from the portable devices;

a stationary detector to detect the identification signals if they exceed a selectable response of said stationary detector;

a setting unit for setting the selectable response of said stationary detector to a level such that the identification signals are detected only if the respective portable devices are located relative to the stationary detector in positions where persons can perceive performance of the broadcast program; and a determining unit for determining the number of persons within a location of interest at which the broadcast program is being performed, comparing that number to the number of identification signals being detected by the detector, and if the number of identification signals being detected exceeds the determined number of persons within the location of interest, adjusting the response of the detector so as to eliminate the identification signal having the weakest signal.

14. An apparatus for identifying members of an audience tuned to a program broadcast by a programming signal source, comprising:

a plurality of portable devices to be carried by members of the audience, said portable devices having personal identification signals stored therein, and transmitting units for periodically transmitting said identification signals from the portable devices;

a stationary detector to detect the identification signals if they exceed a selectable response of said stationary detector;

a setting unit for setting the selectable response of said stationary detector to a level such that the identification signals are detected only if the respective portable devices are located relative to the stationary detector in positions where persons can perceive performance of the broadcast program; and a determining unit for determining the number of persons within a location of interest at which the broadcast program is being performed, comparing that number to the number of identification signals being detected by the detector, and if the determined number of persons within the location of interest exceeds the number of identification signals being detected, generating an alert to activate the portable devices.

15. The method of claim 11, wherein the broadcast program is transmitted by a programming signal source in combination with a surveying code, the method further comprising:

detecting said surveying code and associating said surveying code with said identification signals detected by the detector.

16. The method of claim 12, wherein the broadcast program is transmitted by a programming signal source in combination with a surveying code, the method further comprising:

detecting said surveying code and associating said surveying code with said identification signals detected by the detector.

17. The apparatus of claim 13, wherein the broadcast program is transmitted by a programming signal source in combination with a surveying code, the apparatus further comprising:

a detecting unit for detecting said surveying code and associating said surveying code with said identification signals detected by the detector.

18. The apparatus of claim 14, wherein the broadcast program is transmitted by a programming signal source in combination with a surveying code, the apparatus further comprising:

a detecting unit for detecting said surveying code and associating said surveying code with said identification signals detected by the detector.

* * * * *